US008241095B2

(12) United States Patent
Anderson

(10) Patent No.: US 8,241,095 B2
(45) Date of Patent: Aug. 14, 2012

(54) ABRASION APPARATUS WITH AN ABRADING BELT AND PRODUCT CHAMBERS

(75) Inventor: Alexander Stephen Anderson, Solihull (GB)

(73) Assignee: Koolmill Systems Ltd., West Midlands (GB)

( * ) Notice: Subject to any disclaimer, the term of this patent is extended or adjusted under 35 U.S.C. 154(b) by 539 days.

(21) Appl. No.: 12/311,680

(22) PCT Filed: Oct. 9, 2007

(86) PCT No.: PCT/GB2007/003815
§ 371 (c)(1),
(2), (4) Date: Apr. 8, 2009

(87) PCT Pub. No.: WO2008/043991
PCT Pub. Date: Apr. 17, 2008

(65) Prior Publication Data

US 2009/0276968 A1 Nov. 12, 2009

(30) Foreign Application Priority Data

Oct. 9, 2006 (GB) ..... 0619926.9

(51) Int. Cl.
*B24B 31/00* (2006.01)

(52) U.S. Cl. ..... 451/326; 451/328

(58) Field of Classification Search ..... 451/32, 451/326, 328, 327
See application file for complete search history.

(56) References Cited

U.S. PATENT DOCUMENTS

| | | | | | |
|---|---|---|---|---|---|
| 208,642 | A | * | 10/1878 | Shanton | 241/2 |
| 258,552 | A | * | 5/1882 | Brown | 241/102 |
| 581,908 | A | * | 5/1897 | Gent et al. | 241/9 |
| 5,377,916 | A | * | 1/1995 | Anderson | 241/7 |
| 5,830,042 | A | * | 11/1998 | Anderson | 451/59 |

* cited by examiner

*Primary Examiner* — Maurina Rachuba
(74) *Attorney, Agent, or Firm* — Ober, Kaler, Grimes & Shriver; Royal W. Craig

(57) ABSTRACT

An apparatus and method for abrading the surface of objects are disclosed. The apparatus comprises a chamber, an abrasive surface defining a wall of said chamber and drive means for moving the abrasive surface relative to the chamber. In use, the aforementioned relative movement promotes circulation of the objects within the chamber, wherein the chamber is shaped such that regions of flow stagnation of the objects within the chamber are avoided or minimized. Additionally or alternatively, the chamber may be shaped to approximate the peripheral flow path of the objects within the chamber.

16 Claims, 3 Drawing Sheets

ABRASION APPARATUS WITH AN ABRADING BELT AND PRODUCT CHAMBERS

This invention relates generally to an apparatus and a method for surface treatment of objects. More specifically, but not exclusively, the invention relates to apparatus and methods for surface abrasion of small objects, for example seeds, including cereals, legumes, nuts and the like; cleaning aggregate and objects of wood, plastics, mineral or metal.

Various apparatus for surface abrasive treatment of small objects are already known. Typical apparatus comprise, in combination, a constant depth chamber, means for providing an abrasive moving bottom which passes under a transverse wall of the chamber, an inlet for objects to be abraded, and an outlet for abraded objects. The apparatus is arranged so that, in use, objects circulate in the chamber and material removed from the objects passes under the transverse wall. The chamber has a top, opposed to the bottom, the top being sufficiently close to the bottom that, in use, pressure is exerted on the circulating objects to press the lowermost objects against the bottom.

In the aforementioned apparatus, an endless belt having an abrasive surface moves over a plate to provide the abrasive moving bottom. The alignment of the belt with the generally flat plate is not always accurate, leading to an increase in power consumption and a risk that there will be incomplete separation of the abraded material from the abraded small objects.

In order to address these issues, EP 0755304 proposes an apparatus in which small objects are milled in a machine comprising a rotating vertical drum having an endless abrasive belt attached to the outer surface of the drum. Constant depth chambers having a rectangular cross-section are spaced about the drum so that the belt acts as a floor to the chambers with a slight gap between each chamber and the belt. The objects are passed vertically downwards and abraded by the belt. Surface material removed from the objects passes through the gap directed through a subsidiary outlet alongside the main outlet of each chamber.

The present invention has been developed after finding conventional chamber shapes used in the aforementioned prior art apparatus are prone to regions of flow stagnation, which results in inconsistent treatment of the objects treated therein.

It has also been observed that effectiveness of the treatment process decreases as material is abraded from the objects from the point of introduction into the chamber to the point of exit from the chamber.

Consequently, the invention seeks to provide an improved apparatus which mitigates drawbacks associated with the apparatus disclosed in EP 0755304.

In one aspect, the invention provides an apparatus for abrading the surface of objects comprising a chamber, an abrasive surface defining a wall of said chamber and drive means for moving the abrasive surface relative to the chamber, whereby, in use, said relative movement promotes circulation of the objects within the chamber, the chamber being shaped such that regions of flow stagnation of the objects within the chamber are avoided or minimised.

In a second aspect, the invention provides an apparatus for abrading the surface of objects comprising a chamber, an abrasive surface defining a wall of said chamber and drive means for moving the abrasive surface relative to the chamber, whereby, in use, said relative movement promotes circulation of the objects within the chamber, the chamber being shaped to approximate the peripheral flow path of the objects within the chamber.

The chamber may have a substantially rectangular cross-section with at least one chamfered corner, such as a pair of chamfered corners.

Alternatively or additionally, the chamber may comprise first and second opposite wall portions extending toward the abrasive surface, the second wall portion being spaced from the first wall portion in the direction of movement of the abrasive surface. Preferably, the chamber further comprises a third wall portion adjoining the first and second wall portions, wherein the third wall portion is shaped to at least partially approximate the peripheral flow path of the objects.

More preferably, the apparatus further comprises a gap between the second wall portion and the abrasive surface, the gap being dimensioned to selectively allow the abraded surface material to exit therethrough. The clearance to said abrasive surface defined by said gap is preferably approximately 0.25 mm. The chamber may further comprise an extension wall adjacent the gap for directing the abraded surface material to a secondary outlet. The apparatus may further comprise means for drawing a vacuum outside the chamber to draw the abraded surface material from the secondary outlet.

The chamber may further comprise an inlet, the objects being supplied thereto, and a primary outlet for discharging abraded objects.

The abrasive surface may be provided by an endless belt.

Optionally, the apparatus may further comprise auger means arranged to feed the objects into the chamber under pressure to urge the objects against the abrasive surface.

Preferably, the apparatus further comprises a drum member, wherein the abrasive surface comprises a surface of the drum member and the drive means effects rotation of the drum.

The abrasive surface may be substantially vertical.

Optionally, the depth of the chamber may increase and/or decrease between the inlet and the primary outlet. Preferably, the depth of the chamber increases between the inlet and the primary outlet.

Another aspect of the invention provides a method of abrading objects to abrade surface material therefrom, the method comprising the steps of introducing the objects into a chamber having a wall defined by an abrasive surface and moving the abrasive surface relative to the chamber, whereby in use, said relative movement promotes circulation of the objects within the chamber, the chamber being shaped such that regions of flow stagnation of the objects within the chamber are avoided or minimised.

The method may further comprise the step of selectively allowing the abraded surface material to exit through a gap between a wall portion of the chamber and the abrasive surface.

Preferably, the objects are introduced into the chamber through an inlet and exit through a primary outlet for discharging abraded objects.

Optionally, the objects are introduced into the chamber under pressure to urge the objects against the abrasive surface.

The method may further comprise the step of drawing a vacuum outside the chamber to draw the abraded surface material from the gap.

The objects may be grains of rice. The clearance to said abrasive surface defined by said gap may be about 0.25 mm.

The abrasive surface may be substantially vertical, the method further comprising allowing abraded material to fall through the chamber under the force of gravity.

The method may further comprise passing the objects through the chamber more than once.

The optimal shape of chamber for minimizing the regions of flow stagnation in the apparatus may be determined, for example, by providing a chamber comprising a transparent wall; moving the abrasive surface relative to the chamber; and altering the shape of the chamber to at least partially correspond to the peripheral flow path of the objects.

Preferably, the transparent wall comprises clear plastics material, for example acrylic polymer material.

A further aspect of the invention provides an apparatus for abrading the surface of objects comprising a chamber, an abrasive surface defining a wall of said chamber and drive means for moving the abrasive surface relative to the chamber, wherein the chamber comprises an inlet and an outlet, the depth of the chamber increasing and/or decreasing between the inlet and outlet.

One embodiment of the invention will now be described, by way of example only, with reference to the accompanying drawings, in which.

Figure 1:
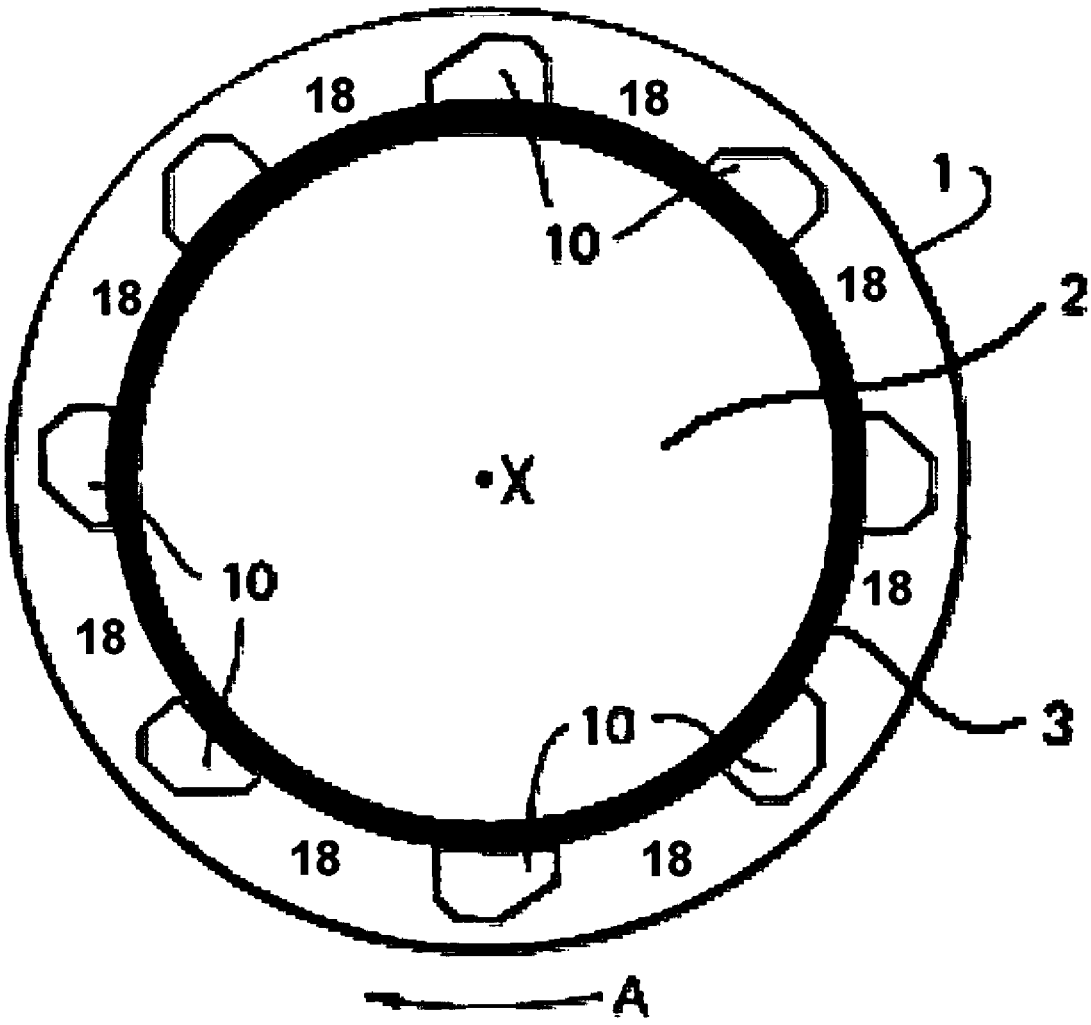
FIG. 1 is a top view of apparatus of the invention.
Figure 2:
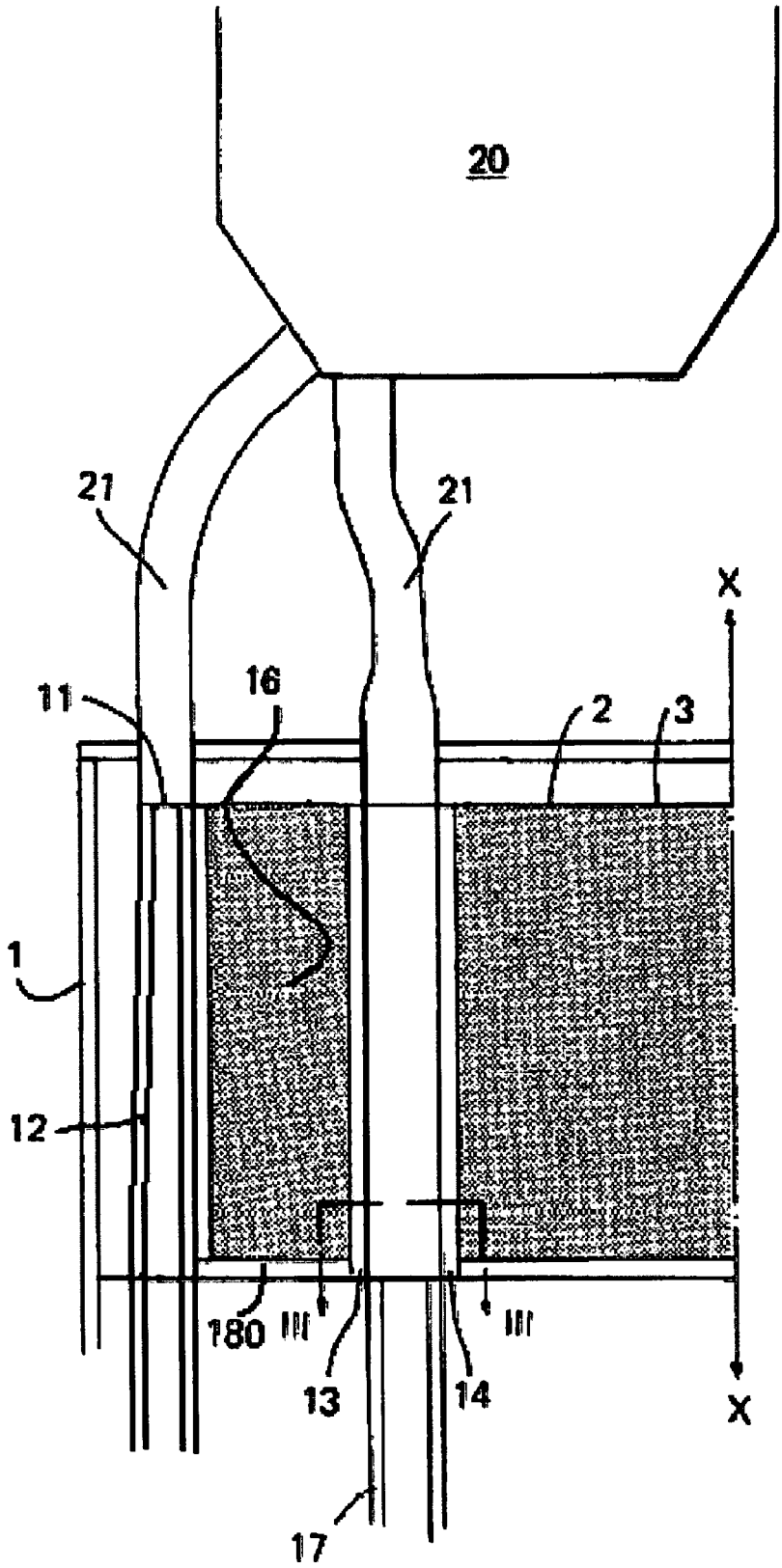
FIG. 2 is a side view of the apparatus of FIG. 1 showing two chambers of the apparatus with a loading hopper.

As shown in FIGS. 1 and 2, the apparatus comprises a housing 1, a drum 2, a drive motor (not shown) and eight treatment chambers 10.

The housing 1 is a cylindrical shell with a top cover. The top cover includes holes (not shown) through its thickness.

The drum 2 is cylindrical in shape and includes a belt 3 affixed to its circumferential surface. The drum 2 has a central axis X about which it rotates in direction A. The belt 3 includes a coating of sand or grit on a backing of cloth, paper or plastics, the particles being held in place by a resin or like bond. The drive motor (not shown) is coupled to the drum and effects the aforementioned rotation of the drum about the central axis X.

Figure 3:
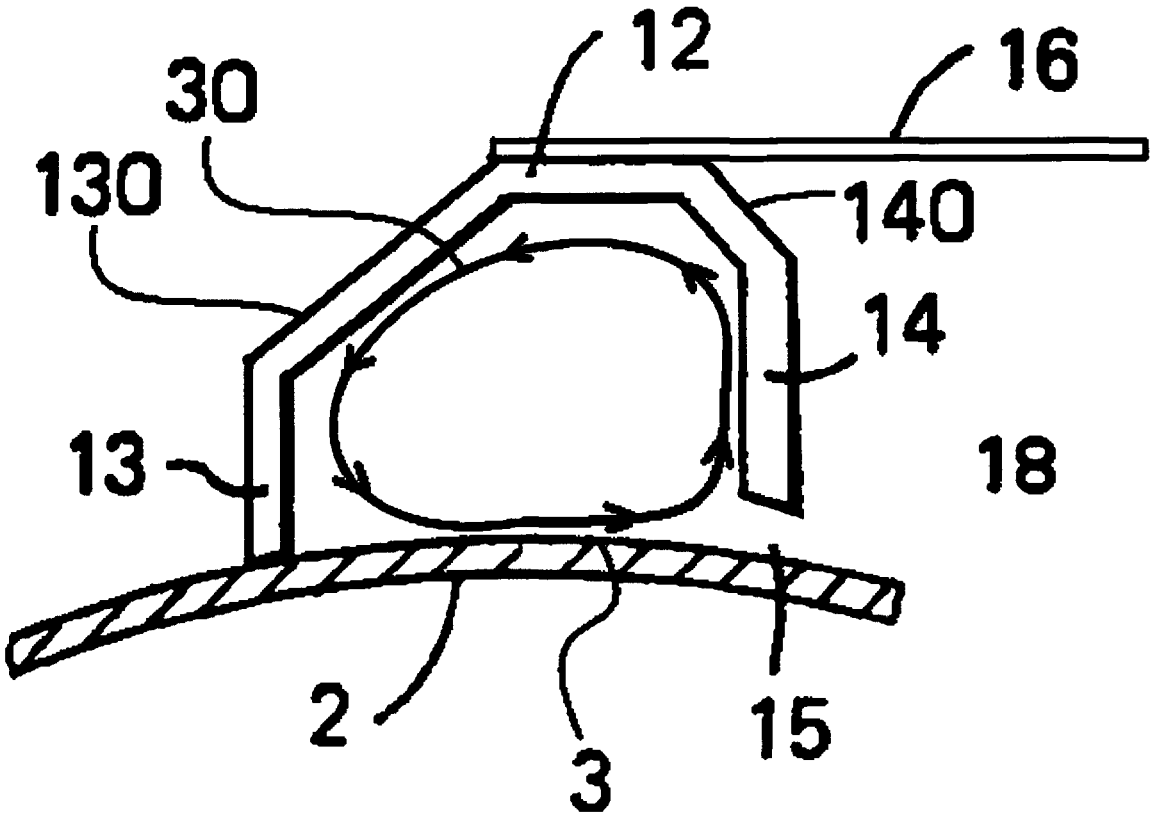
FIG. 3 is a section taken on line III-III on FIG. 2.

The chambers 10 are elongate channel sections, which have a substantially U-shaped cross-section as shown in FIG. 3. Each chamber 10 includes first and second side walls 13 and 14, an external wall 12 perpendicular to the two side walls 13 and 14 and two angled walls 130 and 140 joining each respective side wall 13, 14 to the external wall 12. An optional extension wall 16 extends from the second side wall 14, is substantially perpendicular thereto and defines a discharge area 18. The width of the side walls 13, 14, and consequently the depth of the chambers 10, may increase between the inlet 11 and the outlet 17 (see FIG. 2).

Referring now to FIGS. 1 and 2, the drum 2 is located within the housing 1 and is substantially coaxial therewith. The chambers 10 are equidistantly spaced about the circumference of the drum 2 and extend generally parallel to the axis X of the drum 2. The open end of the channel section of the chambers 10 is adjacent to the belt 3 such that the belt 3 defines a wall of the chamber 10.

As shown in FIG. 3, the first side wall 13 is adjacent the belt 3 with minimal clearance therebetween. The second side wall 14 is offset from the belt 3 to define a gap 15 therebetween. The extension wall 16 extends from the second side wall 14 in a direction substantially tangential to the drum 2.

The top of each chamber 10 defines an inlet 11 to the chamber 10 (see FIG. 2). A main outlet 17 is located at the bottom of each chamber 10. The discharge area 18 is also open at the base of the apparatus to form a subsidiary outlet 180. A loading hopper 20 is located above the apparatus and includes feed pipes 21 connected thereto. Each feed pipe 21 is connected to the loading hopper, extends through one of the holes (not shown) in the housing 1 and is connected to the inlet 11 of one of the chambers 10.

In use, the drive motor effects the rotation of drum 2 in direction A, while the objects to be abraded are loaded into the hopper 20 and fed via the feed pipes 21 to the inlet 11 of one or more chambers 10.

As the drum 2 rotates, it abrades the objects adjacent to its surface to remove a portion of the surface material. The objects pass from the inlet 11 to the outlet 17 of each chamber, the abraded material being urged through the gap 15 under the side-wall 14 and directed by the extension wall 16 to the outlet 180, preferably under the force of gravity and/or suction.

The objects circulate along a predictable path within the chamber 10 under the action of the abrasive surface of the rotating drum 2 so that they contact abrasive surface 3 repeatedly and an outer layer of the objects is removed. The peripheral flow path in the embodiment described above is shown by directional line 30. The material removed passes under the wall 14 through the gap 15 and through the outlet 180. The abraded objects leave the chamber via outlet 17. Objects are thus collected separately from the material removed and, for example, are passed into collection bags (not shown).

The outlet is of reduced size compared to the cross-section of the chamber 10, so as to restrict the flow of objects leaving the chamber such that a controllable back pressure is generated in the chamber 10. The pressure urges the object against the belt 3 of the rotating drum 2.

The diameter of the main outlet 17 is a first control over the extent of removal of the surface material. However, the local pressure within the chamber 10 will be dependent on inter alia the geometry of the chamber 10, the speed of travel of the belt 3 and its abrasiveness, and these parameters may be used as a second level of control.

The chamber 10 shown in FIG. 3 has been shaped to broadly correspond to the peripheral flow path of the objects whilst maintaining a simplified shape for ease of manufacture. The shape of the chamber 10 may be altered to more closely match the peripheral flow path of the objects, however this would increase the complexity of manufacturing the chambers 10.

Shaping the chambers to correspond to the peripheral flow path of the object minimises the regions of flow stagnation within the chambers 10. The presence of regions of flow stagnation within the treatment chambers 10 may result in objects passing from the inlet to the outlet being under-treated or, in extreme cases not treated at all. Consequently, the present invention provides an improved apparatus which offers a more consistent means of treated objects therein.

The path of circulation of the grains, and consequently the peripheral flow path 30, is dependent on a number of factors, for example the size, shape and properties of the objects, depth and width of the treatment chamber 10, the speed at which the drum 2 rotates, the coarseness of the belt, and so on. As stated above, it is known to vary the geometry of the chambers in order to alter the treatment parameters, which may be required for different objects and/or different treatment requirements. It is therefore necessary to re-assess the optimal chamber shape for each collection of parameters.

In order to determine the peripheral flow path of the objects being treated in the chambers, the walls of at least one of the chambers can be fabricated using transparent material such as acrylic polymer material, for example that sold under the brand Plexi-glass™. The drum 2 is rotated in direction A, while the objects to be abraded are fed to the inlet 11 of the chamber 10. The circulation of the grains is then observed through the transparent chambers. The shape of at least one chamber is modified to correspond to the observed circulation path. This may require a number of iterations to reach the optimal shape, however, the use of Plexi-glass™, which is easily formed, makes this process relatively uncomplicated. For production purposes however, the chambers are preferably constructed from stainless steel.

In one example, drum 2 is run to produce a surface speed of about 10 meters/sec. Rice grains are fed via the inlet 11 of the or each chamber 10. The grains are fed through the chamber 10 at a rate to generate pressure as described above and to urge the objects against the abrasive belt 3 of the drum 2 as the objects pass through the chambers 10. The material removed would be bran and/or husk and the abraded objects would be whitened rice grains.

It will be appreciated that the applied pressure required to remove subsequent layers of whitened rice increases as the rice whitens. This is due to the higher toughness of the core of the grain. Consequently, it is advantageous to gradually increase the pressure exerted on the grains as they travel through the chamber 10 in order to maintain a consistent rate of removal of surface material. This is achieved by gradually increasing the depth of the chamber as previously described and as shown in FIG. 2.

Contradistinctively, other objects to be abraded using the apparatus of the invention may require less pressure as outer layers are abraded. It is therefore within the scope of the invention to increase and/or decrease the depth of the chambers in order to provide improved control over treatment parameters throughout the treatment process.

The invention is not limited to the embodiment shown. An auger may be associated with each chamber 10 to supply the objects into the respective chamber 10, either from the top or the bottom. Pressure may be generated by use of the auger and that pressure is generated over a large area in the chamber thereby improving the efficiency of the apparatus. The apparatus may include means for restricting the flow of abraded objects from the main outlet 17 in which case the pressure generated depends on a balance between the effect of the auger (e.g. its speed of rotation) and the degree of restriction of the outlet 17.

The drum 2 may be replaced with a flat surface on which the belt translates. The wall 16 may be flexible or rigid. A vacuum may be drawn. The walls 12, 13, 14, 130, 140 of the chamber may be flat or curved. In the embodiment shown the chambers are arranged all about the rotary drum. The invention also includes apparatus in which some chambers are disposed in an arc of the drum and means are provided on the opposite side of the drum to tension and track the belt. The apparatus may comprise a horizontal arrangement as described above.

The invention claimed is:

1. An apparatus for abrading the surface of objects comprising:

a chamber defined by a plurality of walls, an abrasive surface defining one of said plurality of walls of said chamber, and drive means for moving the abrasive surface relative to the other of said plurality of walls of said chamber, said chamber having a cross-section that is asymmetric about a central line intersecting said abrasive surface;

whereby in use, said relative movement promotes circulation of the objects within the chamber, the asymmetric shape of said chamber minimizing regions of flow stagnation of the objects within the chamber.

2. The apparatus for abrading the surface of objects according to claim 1, wherein the other of said plurality of walls of said chamber include two perpendicular side walls and at least two angled walls joining the perpendicular side walls and shaped to approximate a peripheral flow path of the objects within the chamber.

3. An apparatus as claimed in claim 1, wherein the chamber comprises a substantially rectangular cross-section with at least one chamfered corner.

4. An apparatus as claimed in claim 1, wherein the chamber comprises first, second and third wall portions, the first and second wall portions extending toward the abrasive surface, the second wall portion being spaced from the first wall portion in the direction of movement of the abrasive surface, the third wall portion joining the first and second wall portions and being non-planar to at least partially approximate the peripheral flow path of the objects within the chamber.

5. An apparatus as claimed in claim 4, further comprising a gap between the second wall portion and the abrasive surface, the gap being dimensioned to selectively allow the abraded surface material to exit there through.

6. An apparatus as claimed in claim 5, wherein the chamber further comprises an extension wall for directing the abraded surface material to a secondary outlet.

7. An apparatus as claimed in claim 1, further comprising a drum member, wherein the abrasive surface comprises a surface of the drum member and the drive means effects rotation of the drum member.

8. An apparatus as claimed in claim 1, wherein the abrasive surface is substantially vertical.

9. An apparatus as claimed in claim 8, wherein the depth of the chamber increases and/or decreases between the inlet and the primary outlet.

10. A method of abrading objects to abrade surface material therefrom, the method comprising the steps of introducing the objects into a chamber having a first wall defined by an abrasive surface and a second wall bounding said chamber and defining a cross-section that is non-symmetric about a central line intersecting said abrasive surface, and moving the abrasive surface relative to the second wall and chamber to promote circulation of the objects within the chamber about a flow path, the chamber being shaped such that regions of flow stagnation within the chamber and outside said flow path are minimized.

11. A method as claimed in claim 10, further comprising the step of selectively allowing abraded surface material from objects within the chamber to exit through a gap between a wall portion of the chamber and the abrasive surface.

12. A method as claimed in claim 11, further comprising the step of drawing a vacuum outside the chamber to draw the abraded surface material from the gap.

13. A method as claimed in claim 10, wherein the abrasive surface is substantially vertical, the method further comprising allowing abraded surface material from objects within the chamber to fall through the chamber under the force of gravity.

14. A method as claimed in claim 10, further comprising passing the objects through the chamber more than once.

15. An apparatus for abrading the surface of objects comprising a chamber, an abrasive surface defining a wall of said chamber and drive means for moving the abrasive surface relative to the chamber, whereby, in use, said relative movement promotes circulation of the objects within the chamber, the chamber comprising an asymmetric cross-sectional shape to approximate the asymmetric peripheral flow path of the objects within the chamber.

16. An apparatus as claimed in claim 15, wherein the cross-section of the chamber is asymmetric about a central horizontal plane that is substantially perpendicular to the abrasive surface.

* * * * *